US007004803B2

(12) United States Patent
Ruffe

(10) Patent No.: US 7,004,803 B2
(45) Date of Patent: Feb. 28, 2006

(54) OUTBOARD TROLLING MOTOR DEPLOYMENT AND CONTROL SYSTEM

(76) Inventor: Steven E. Ruffe, 110 Arvida Pkwy., Coral Gables, FL (US) 33156

( * ) Notice: Subject to any disclaimer, the term of this patent is extended or adjusted under 35 U.S.C. 154(b) by 0 days.

(21) Appl. No.: 10/758,462

(22) Filed: Jan. 15, 2004

(65) Prior Publication Data

US 2005/0159053 A1 Jul. 21, 2005

(51) Int. Cl.
*B63H 5/125* (2006.01)

(52) U.S. Cl. ..... 440/53; 440/6

(58) Field of Classification Search ..... 440/6, 440/53, 61 T–61 J, 1, 2, 54
See application file for complete search history.

(56) References Cited

U.S. PATENT DOCUMENTS

| | | | | |
|---|---|---|---|---|
| 2,119,281 | A | 5/1938 | Luders, Jr. | |
| 3,250,239 | A * | 5/1966 | Garate | 440/12.65 |
| RE28,176 | E | 10/1974 | Horton | |
| 4,634,390 | A | 1/1987 | Baird | |
| 4,854,902 | A | 8/1989 | Havins | |
| 4,911,398 | A | 3/1990 | DiIulio et al. | |
| 4,955,834 | A | 9/1990 | Henderson et al. | |
| 5,131,875 | A * | 7/1992 | Lee | 440/7 |
| 5,277,630 | A | 1/1994 | Clark | |
| 5,292,269 | A * | 3/1994 | Plost et al. | 440/1 |
| 5,505,155 | A * | 4/1996 | Adams | 114/338 |
| 5,599,216 | A | 2/1997 | Reightley | |
| 5,725,401 | A * | 3/1998 | Smith | 440/6 |
| 5,842,895 | A | 12/1998 | DeVito, Jr. | |
| 6,132,267 | A * | 10/2000 | Campbell | 440/6 |
| 6,280,267 | B1 | 8/2001 | Griffith, Sr. et al. | |
| 6,447,348 | B1 | 9/2002 | Gilley | |
| 6,520,813 | B1 | 2/2003 | DeVito, Jr. | |
| 6,799,528 | B1 * | 10/2004 | Bekker | 114/151 |

* cited by examiner

*Primary Examiner*—Ed Swinehart
(74) *Attorney, Agent, or Firm*—Malloy & Malloy, P.A.

(57) ABSTRACT

An outboard trolling motor deployment assembly and control system for a boat which is afloat in a body of water includes an outboard trolling motor assembly having at least one, but preferably, one pair of outboard trolling motors. A deployment assembly is disposed in cooperative engagement with the outboard trolling motor assembly and is structured to facilitate positioning the outboard trolling motors between a stowed position and at least one predetermined deployed position. The predetermined deployed position is at least partially defined by a thrust axis of the outboard trolling motor assembly being disposed substantially parallel to a longitudinal centerline of the boat. The system also includes a control assembly, wherein the control assembly may include one or more actuation, direction, and/or speed switches.

46 Claims, 5 Drawing Sheets

OUTBOARD TROLLING MOTOR DEPLOYMENT AND CONTROL SYSTEM

BACKGROUND OF THE INVENTION

1. Field of the Invention

The present invention is directed to an outboard trolling motor deployment and control system for a boat. In particular, the system comprises a deployment assembly disposed in cooperative engagement with an outboard trolling motor assembly having at least one thrust axis. The deployment assembly is structured such that the outboard trolling motor assembly may be positioned between a stowed position and at least one predetermined deployed position while maintaining the thrust axis substantially parallel to a longitudinal centerline of the boat. The system of the present invention also comprises a control assembly disposed in a communicative relationship with the outboard trolling motor assembly.

2. Description of the Related Art

At the turn of the last century, there were more than 12 million boats registered throughout the United States, and many of these boats are presumedly utilized for various types of fishing activities. Most fishing boats include at least one main motor which permits the operator to propel the boat from one location to another, for example, from a dock or boat launch to a favorite fishing hole. Typically, the main motors employed to permit the boat to travel long distances are sized to propel the boat at relatively high speeds, such that the boat creates a wake in its trail, the wake being a large area of disturbed water. In addition to the wake, such motors tend to produce a significant amount of noise, which is readily transmitted through the water. However, once the boat arrives in the vicinity of the fishing hole, it is no longer desirable to use a motor that creates a wake or produces noise, as it may either scare fish from the area or distract them from taking a bait presented by a fisherman.

As such, much smaller motors, commonly known as trolling motors, are often employed to propel the boat at significantly reduced speeds [i.e. trolling speeds], when the boat approaches or is located in an area where the operator wishes to fish. Typically, such trolling motors are structured to propel the boat at minimal speeds such that there is little discernable wake created. In addition, many modern trolling motors are driven by electric motors which operate almost silently so as not to betray the fisherman's presence to his prey.

Given the relatively small size of most trolling motors, they are typically structured only to be positioned into the water while they are being used. While the boat is traveling at normal speeds under power of the main motor or motors, the trolling motors are normally disposed in a stowed position out of the body of water. This is so as to eliminate drag from the trolling motor as the boat moves through the body of water and, perhaps more importantly, to prevent damage to the trolling motor by the force of the water and/or to the hull of the boat by the trolling motor being forced into contact with the hull.

A variety of devices have been developed to deploy one or more trolling motors from a boat, once it has arrived at a location where the trolling motor is to be used. Many of these devices are structured to temporarily dispose the trolling motor in an operable position into the body of water overtop of a portion of the hull, where at least a portion of the trolling motor and/or the trolling motor mounting assembly extends upward above the portion of the hull. Such mounting devices, however, present a potential point for entangling fishing line, either while casting out line, reeling in line, or by a fish which has taken the bait and is running with the line. Also, such devices are typically structured to dispose the trolling motor off either side of the boat near the bow, which results in an offset, forward steerage point, which makes maneuvering the boat more difficult, and maneuvering the boat at low trolling speeds is difficult at best, even under ideal boating conditions. These devices also typically require the operator to manually align the angle and set the depth and distance from the hull of the boat at which the trolling motor is deployed, which are all critical factors with regard to the operating efficiency of the trolling motor. As such, these devices are often deployed at an angle, depth, and/or distance which does not permit maximum operating efficiency. In addition, these devices typically require the operator to physically adjust the speed and direction of the trolling motor via a shaft or handle located on the trolling motor assembly itself, thus restricting the operator's ability to move freely about the boat to fish.

Attempts to address some of the aforementioned shortcomings have resulted in trolling motor mounting devices wherein essentially no portion of the trolling motor or mounting assembly extend upward above any side of the boat. For example, one such device provides for mounting the trolling motor onto a tab or tongue which is mounted directly behind the boat and is rotated into and out of the body of water. At least one device provides a trolling motor disposed underneath the hull of the boat while in an operable portion and which is retractable into a recess in the underside of the hull of boat while the regular boat motor is utilized. Although each of these devices minimize the risk of entangling the fishing line with the trolling motor and/or mounting assembly, they both position the trolling motor, and more specifically, a propellor of the trolling motor in the path of flow of water that has been disturbed by the passage of the hull of the boat overtop, commonly known as "dirty water," rather than in the undisturbed, "clean water" which passes by on either side of the boat. Dirty water is normally somewhat turbulent and often contains air bubbles, both of which may cause cavitation of the motor resulting in reduced operating efficiency and, more importantly, creating noise that may scare or disturb potential prey. In addition, each of these devices only provide a single position in which the thrust of the trolling motor is substantially parallel with the longitudinal centerline of the boat, which is the most efficient operating position in which to deploy the trolling motor.

At least one other device employs a controller to permit the operator to vary the speed and direction of the trolling motor assembly, remote from the actual trolling motors themselves, via a foot control switch, presumedly to free the operator's hands so that the operator may fish while maneuvering the boat via the trolling motor.

Other devices have been developed which incorporate complex mechanisms to deploy and/or retrieve one or more trolling motors, thus making such devices expensive to manufacture and maintain. Also, the complex nature of these devices may make it more time consuming for the operator to deploy the trolling motor when desired, which may be critical when unexpectedly arriving upon a school of fish which the operator wishes to pursue at trolling speed. Further, it is reasonable to assume that the complexity of such devices will render them less reliable than simpler deployment mechanisms, and thus, more expensive to properly maintain.

As such, it would be beneficial to provide a trolling motor deployment assembly which would allow an operator to quickly and easily deploy at least one trolling motor into at least one predetermined deployed position, wherein the predetermined deployed position is located in undisturbed, "clean water." It would be a further benefit for such a deployment assembly to be structured to dispose a pair of outboard trolling motors into at least one predetermined deployed position. As such, each of the pair of trolling motors is disposed at an equal lateral distance from opposite sides of the boat and at an equal depth below a normal surface of the body of water. In addition, it would be helpful for any such trolling motor deployment assembly to deploy the trolling motors such that thrust generated by each of the trolling motors is maintained substantially parallel to a longitudinal centerline of the boat, to assure optimum operating efficiency of the trolling motors. Furthermore, any such trolling motor assembly would preferably be structured such that no portion of the mounting assembly or trolling motor is disposed above any side wall of the boat while the trolling motor is disposed in an operative position. Also, it would be beneficial for such a trolling motor assembly to include a control assembly structured to permit an operator to control the speed and direction of the boat from a location remote of the trolling motor, such that the operator is free to move about the boat to fish.

SUMMARY OF THE INVENTION

As indicated above, the present invention is directed to an outboard trolling motor deployment and control system for a boat, and in particular, a boat that is afloat in a body of water. The system comprises an outboard trolling motor assembly having at least one outboard trolling motor structured to generate an amount of thrust along a thrust axis. At least one embodiment of the outboard trolling motor assembly of the present invention comprises at least one pair of outboard trolling motors, each of the pair of outboard trolling motors being structured to generate an amount of thrust along a corresponding thrust axis, each thrust axis being disposed substantially parallel to a longitudinal centerline of the boat.

The system of the present invention also comprises a deployment assembly having at least one pair of positionable mounting members each operatively engaging a different one of the outboard trolling motors. One embodiment comprises the deployment assembly disposed in an interconnecting orientation with a transom of the boat and is structured to facilitate rotatably positioning each of the outboard trolling motors along a substantially arcuate path of travel between a stowed position and at least one predetermined deployed position. In addition, the deployment assembly is structured to maintain the thrust axis of each of the outboard trolling motors disposed substantially parallel with the longitudinal centerline of the boat at each point along the substantially arcuate path of travel.

In at least one other embodiment, the deployment assembly is structured to facilitate rotatably positioning each of the outboard trolling motors along the substantially arcuate path of travel between the stowed position and any one of a plurality of predetermined deployed positions. Each predetermined deployed position being at least partially defined by each of the outboard trolling motors disposed laterally outward from an opposite side of the stern of the boat into a substantially undisturbed, or clean water, portion of the body of water.

The system of the present invention also comprises a control assembly disposed in a communicative relationship with at least the outboard trolling motors. The control assembly is further disposed in a communicative relationship with at least one power supply structured and at least temporarily disposed in an energizing relation with the outboard trolling motors. Additionally, the control assembly is structured to at least actuate the outboard trolling motors, either individually or in combination. In at least one embodiment, the control assembly is further structured to permit the operator to vary the speed and/or the direction of each of the trolling motors, either individually, or in combination, such that the speed and/or direction of each trolling motor is varied simultaneously.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
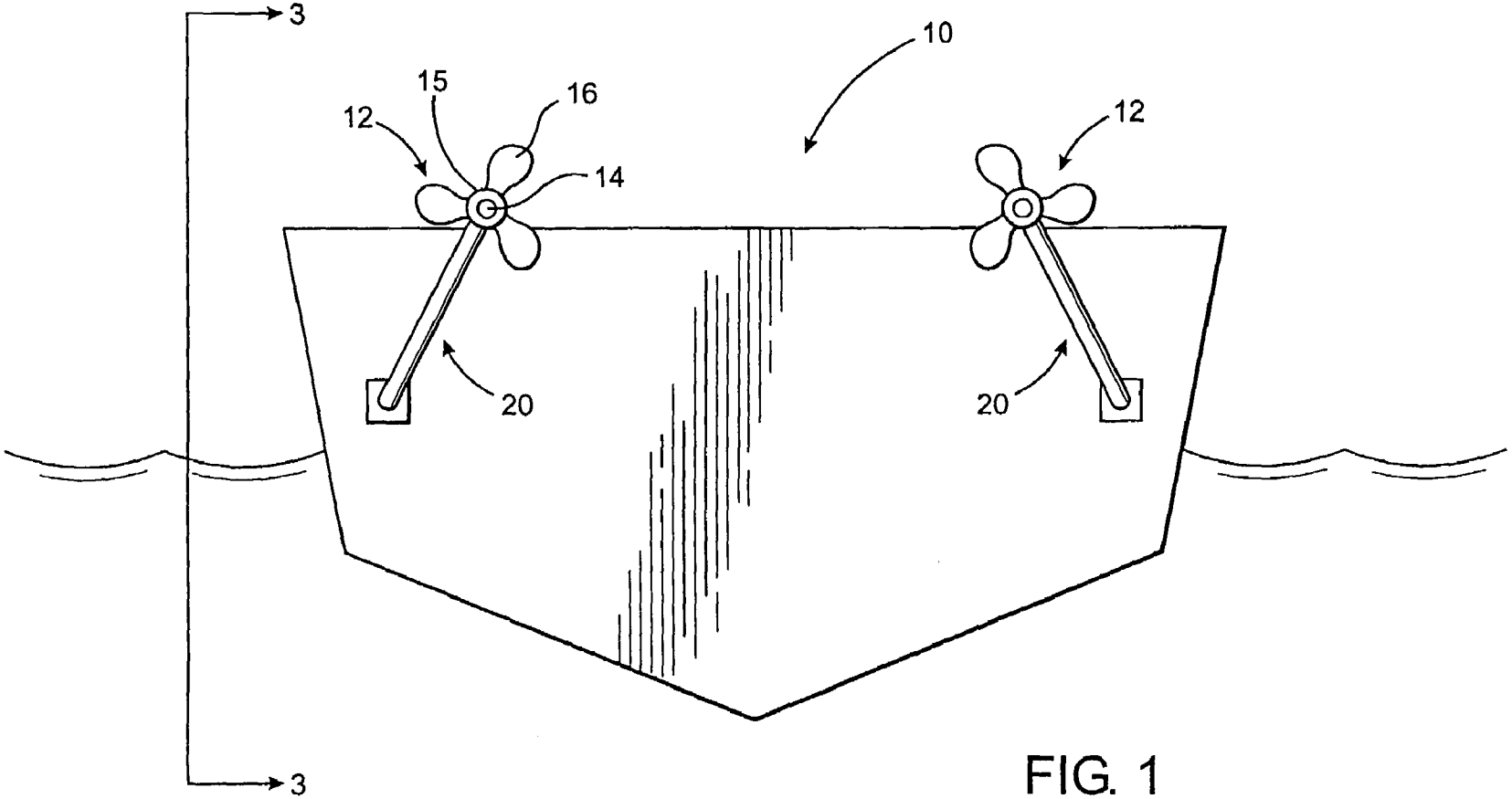
FIG. 1 is an elevation of one preferred embodiment of the system of the present invention illustrating an outboard motor trolling assembly disposed in a stowed position.

The present invention is directed to an outboard trolling motor deployment and control system for a boat, generally as shown at 10 throughout the figures. More in particular, the system 10 of the present invention is structured and disposed for use on a boat which is afloat in a body of water. The system 10 comprises an outboard trolling motor assembly 12 including at least one outboard trolling motor 14. In one preferred embodiment, the outboard trolling motor assembly 12 comprises at least one pair of outboard trolling motors 14.

The outboard trolling motor assembly 12 of the present invention has at least one thrust axis 17 disposed substantially parallel to a longitudinal centerline 18 of the boat. The thrust axis 17 essentially defines a direction of an amount of thrust generated by the outboard trolling motor assembly 12 which propels the boat. Thus, by maintaining the thrust axis 17 substantially parallel with the longitudinal centerline 18 of the boat, the operating efficiency of the outboard trolling motors 14 may be maximized. In particular, the operating efficiency is maximized as a result of the full force of the thrust being directed exactly opposite to a direction of travel of the boat. Any deviation of the direction of the thrust axis 17 from being substantially parallel with the longitudinal centerline 18 of the boat results in some amount less than the full force of the thrust being exactly opposite the direction of travel of the boat, and as such, only some amount less than the full force of the thrust is available to propel the boat.

More in particular, the outboard trolling motors 14 of the present invention are of the type structured to propel a boat at low speeds [i.e. trolling speeds] while creating only a minimal disturbance to the surrounding water, such as, via a wake. Typically, trolling motors 14 comprise small electrically powered motors to further minimize the amount of disturbance created via motor noise, however, it is understood to be within the scope of the present invention for alternate power sources to be utilized to energize the outboard trolling motors 14 of the present invention. The outboard trolling motors 14 include a propeller 16 which is interconnected to the motor 14 via a drive shaft 15. Each of the outboard trolling motors 14 of the present invention is structured to generate an amount of thrust along a corresponding thrust axis 17. Each of the thrust axes 17 is maintained substantially parallel to the longitudinal centerline 18 of the boat, thereby permitting the maximum operating efficiency to be obtained from each of the outboard trolling motors 14, as described above.

Figure 2:
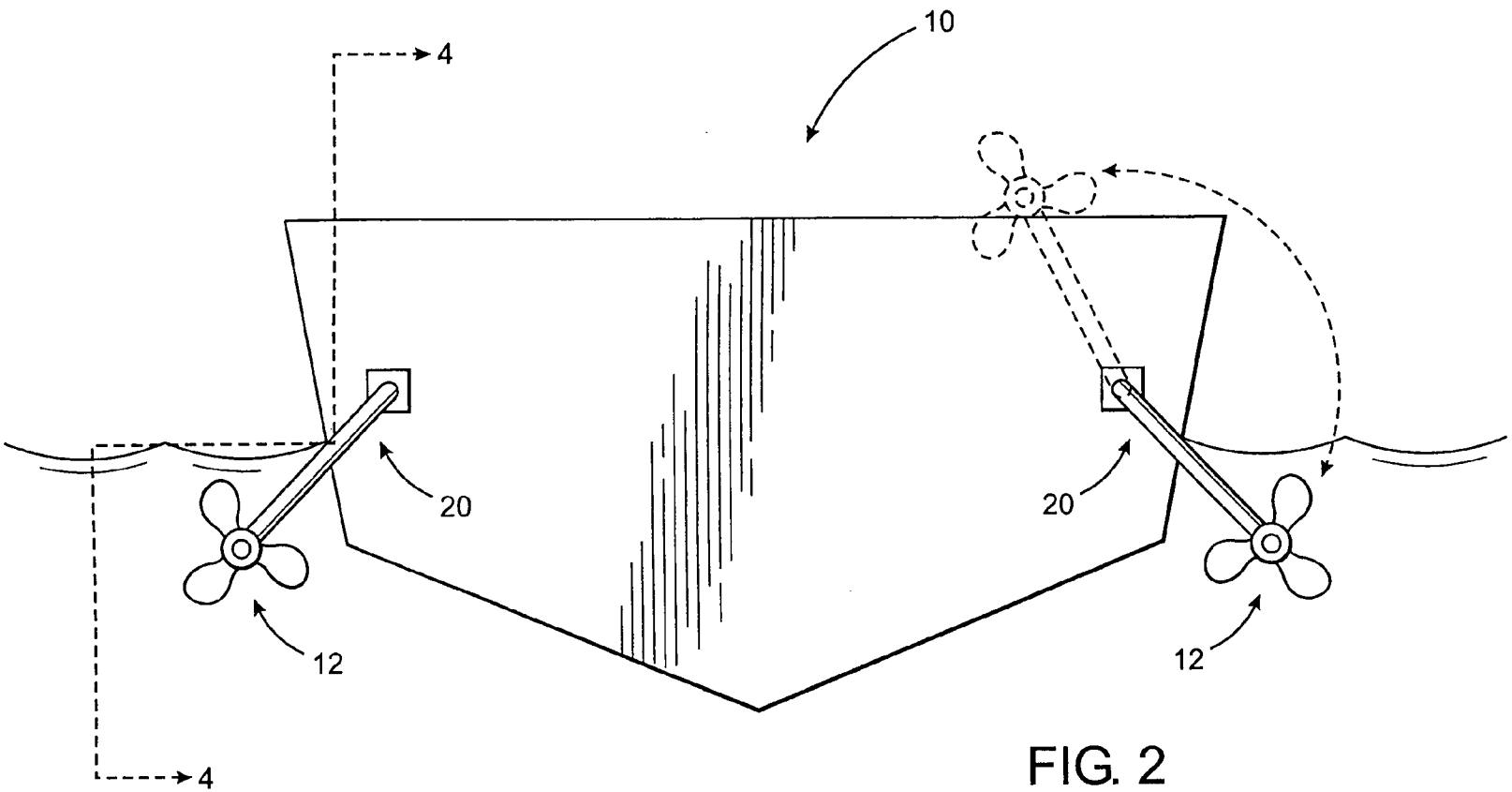
FIG. 2 is an elevation of the embodiment of FIG. 1 illustrating the outboard trolling motor assembly disposed in a deployed position.
Figure 3:
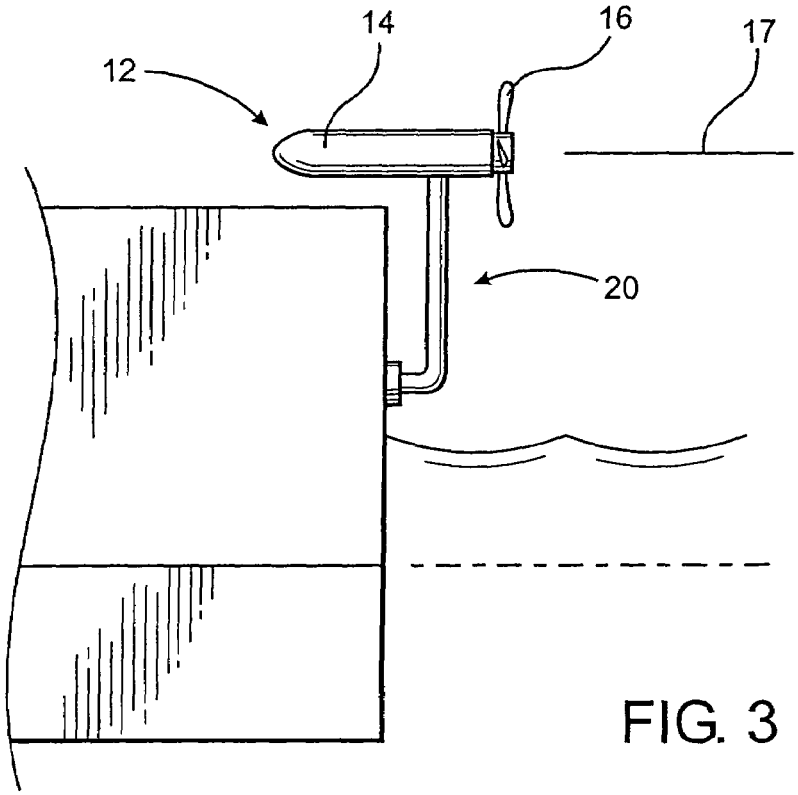
FIG. 3 is a partial side elevation of the embodiment of FIG. 1 along lines 3—3 thereof.
Figure 4:
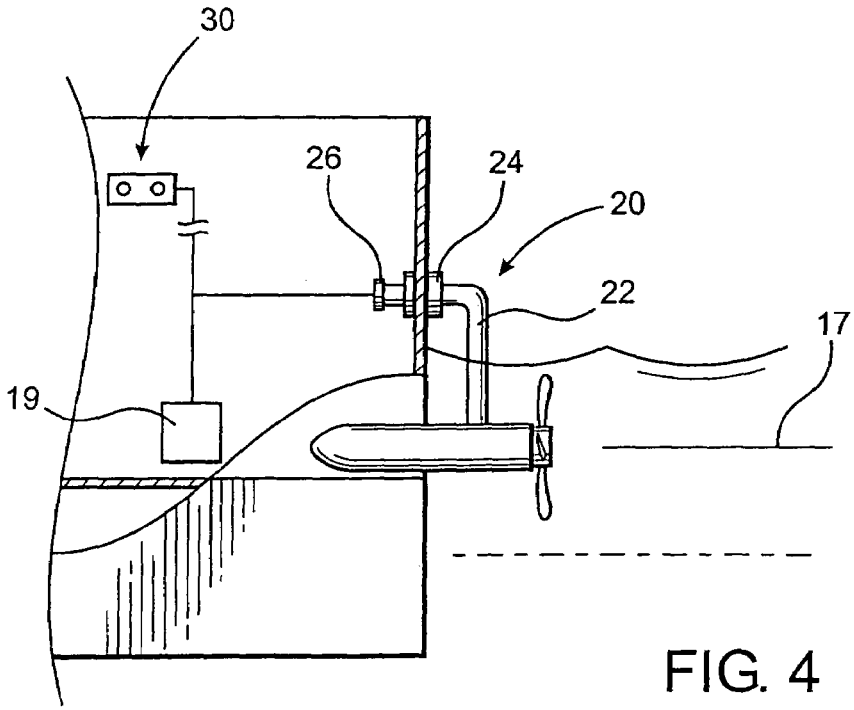
FIG. 4 is a partial cross-section of the embodiment of FIG. 2 along lines 4—4 thereof.

The outboard motor deployment and control system 10 of the present invention also comprises a deployment assembly, generally as shown at 20. The deployment assembly 20 is disposed in a cooperative association with the outboard trolling motor assembly 12. Specifically, the deployment assembly 20 is structured to facilitate positioning the outboard trolling motor assembly 12 between a stowed position, as illustrated in FIG. 1, and at least one predetermined deployed position, as in FIG. 2. The at least one predetermined deployed position is at least partially defined by the outboard trolling motor assembly 12 being disposed laterally outward from at least one side of the boat. In one preferred embodiment, the at least one predetermined deployed position is at least partially defined by each of the pair of outboard trolling motors 14 being disposed laterally outward from an opposite side of the boat, as illustrated in FIG. 2. The predetermined deployed position may be further defined by each of the outboard trolling motors 14 being disposed laterally outward a substantially equal distance from an opposite side of the stern of the boat, also as illustrated in FIG. 2. Further, and again as illustrated in FIG. 2, the predetermined deployed position may be at least partially defined by each of the outboard trolling motors 14 being disposed at a substantially equal depth below a normal surface of the body of water.

In addition, the at least one predetermined deployed position may be further defined by each of the pair of outboard trolling motors 14 being disposed laterally outward from an opposite side of the stern of the boat such that the corresponding thrust axes 17 are submerged into a substantially undisturbed portion of the body of water, or "clean water," surrounding the boat. In a preferred embodiment, each of the thrust axes 17 is further disposed substantially parallel to the normal surface of the body of water. Thus, the predetermined deployed position provides proper lateral, axial, and vertical placement of each of the outboard trolling motors 14 to assure uniform propulsion from each under normal operating conditions, so as to further maximize operating efficiency.

In at least one embodiment, the deployment assembly 20 of the present invention is disposed in an interconnecting orientation with a portion of the hull of the boat. In one preferred embodiment, the deployment assembly 20 is disposed in the interconnecting orientation with a transom of the boat, as illustrated throughout the figures. The deployment assembly preferably includes at least one pair of positionable mounting members 22, each being structured to operatively engage a different one of the pair of outboard trolling motors 14. At least one embodiment of the deployment assembly 20 of the present invention further comprises a pair of mounting sleeve mechanisms 24, each structured to interconnect a different one of the positionable mounting members 22 to the boat through a portion of the hull. Once again, in a preferred embodiment the portion of the hull of the boat is the transom, as illustrated in the figures. The mounting sleeve mechanisms 24 of the deployment assembly 20 of the present invention are further structured to movably interconnect, and in one preferred embodiment, to rotatably interconnect the positionable mounting members 22 through the portion of the hull.

Figure 5:
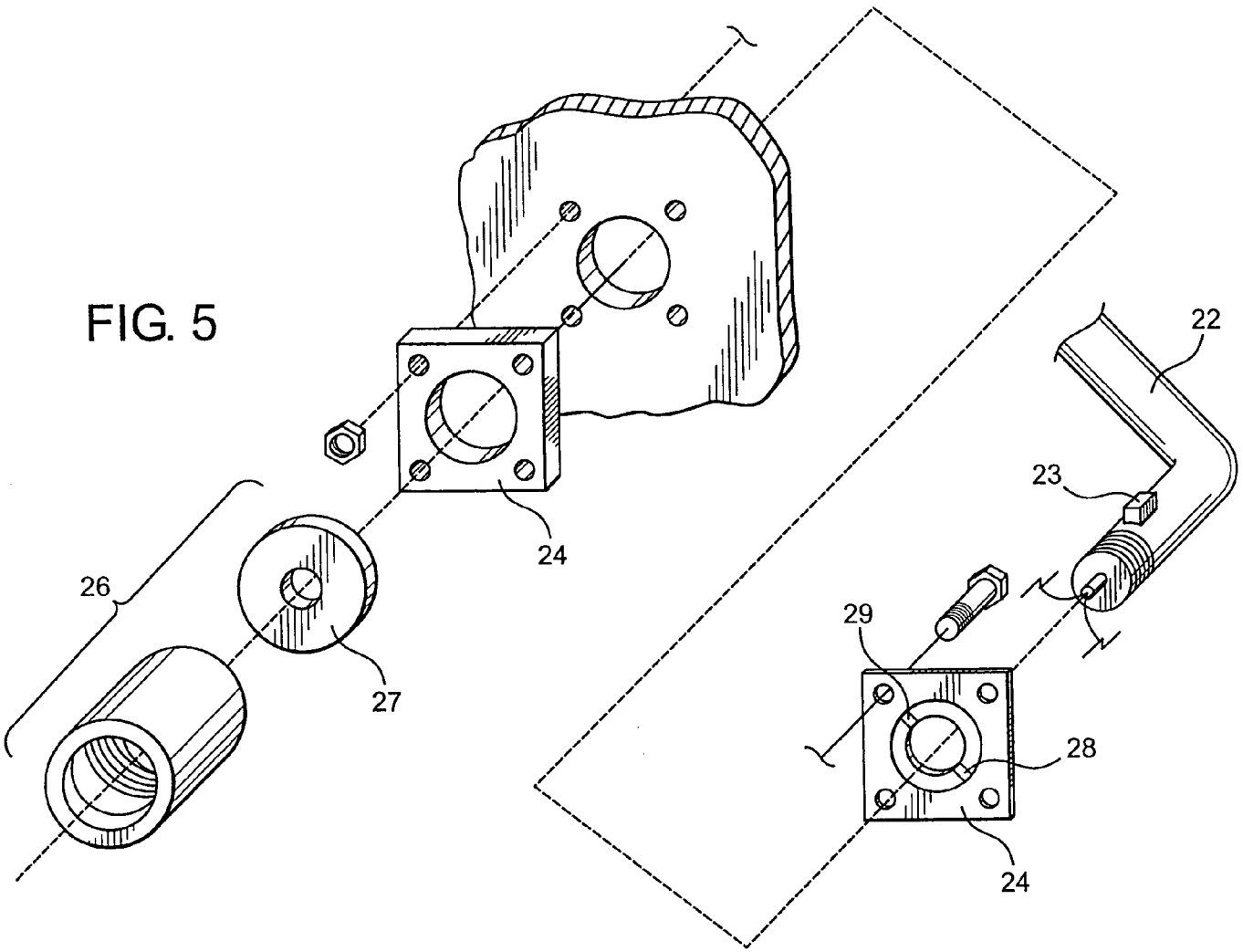
FIG. 5 is a partial exploded perspective view of one preferred embodiment of a deployment assembly of the present invention.
Figure 6:
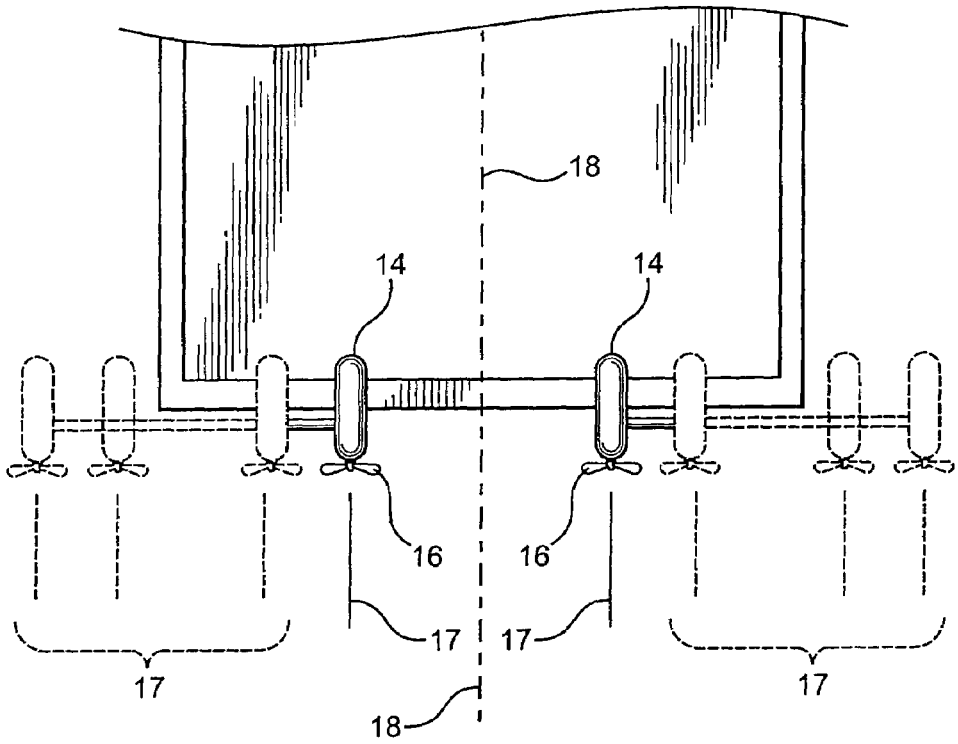
FIG. 6 is a partial plan view of the embodiment of FIG. 1 illustrating the outboard trolling motor assembly disposed in the stowed position and at various points between and including the deployed position.
Figure 7:
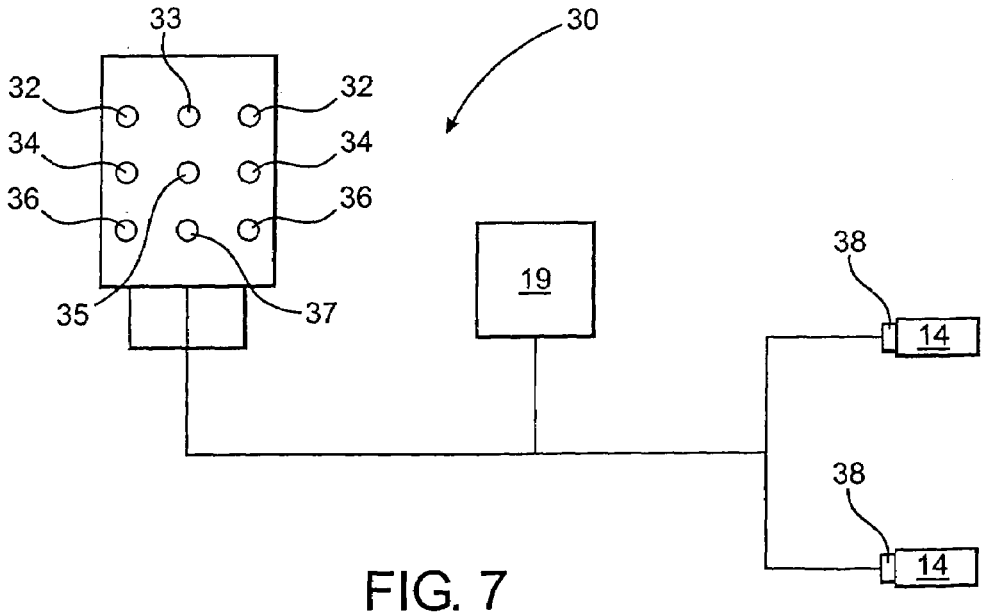
FIG. 7 is a schematic view of one preferred embodiment of a control assembly of the present invention.

In addition, in at least one embodiment of the present invention, each mounting sleeve mechanism 24 includes a sealing mechanism 26 structured and disposed to provide a liquid restrictive interconnection between a corresponding one of the positionable mounting members 22 and the portion of the hull of the boat. More in particular, the liquid restrictive interconnection is at least partially defined by minimizing the amount of liquid which can be transferred from the exterior of the boat to the interior of the boat through the mounting sleeve mechanism 24. The sealing mechanism 26, in one preferred embodiment, may comprise a seal 27, for example, a gasket structured to engage a portion of a corresponding positionable mounting member 22, as illustrated in FIG. 5. As further illustrated in FIG. 5, the sealing mechanism 26 is structured to permit only a portion of the positionable mounting member 22 comprising the power and control interconnections with the corresponding outboard trolling motor 14 to extend through the seal 27 and into the interior of the boat. It will be appreciated that the present invention may encompass other types of sealing mechanisms 26 and/or seals 27 provided they are structured to minimize the amount of liquid which may be transferred from the exterior to the interior of the boat through the mounting sleeve mechanism 24.

As further illustrated in FIG. 5, one preferred embodiment of the deployment assembly 20 of the present invention comprises the positionable mounting members 22 each including a positionable stop member 23. Each positionable stop member 23 is structured to facilitate disposing the corresponding outboard trolling motor 14 between the stowed position and the at least one predetermined deployed position. More specifically, in this preferred embodiment, the corresponding mounting sleeve mechanism 24 comprises at least one deployment stop member 28. Further, as illustrated in FIG. 5, the at least one predetermined deployed position is partially defined by a portion of the positionable stop member 23 abutting a portion of the at least one deployment stop member 28, such that further rotation of the positionable mounting member 22 in the direction of the abutting members is restricted.

Thus, the outboard trolling motor 14 is rotatably disposable into the at least one predetermined deployed position by simply rotating the positionable mounting member 22, and the corresponding outboard trolling motor 14, outward and downward from the stowed position along a substantially arcuate path of travel, as illustrated in FIG. 2, until the positionable stop member 23 abuts the deployment stop member 28. As further illustrated in FIG. 2, the arcuate path of travel, in at least one preferred embodiment, is disposed in a generally vertical plane. At this point, the outboard trolling motor 14 is disposed a predetermined distance laterally outward from the side of the boat, preferably off the stern of the boat, and is submerged into a substantially undisturbed portion of the body of water (i.e. "clean water") at a predetermined depth below and substantially parallel to a normal surface of the body of water. In this predetermined deployed position, the thrust axis 17 of the outboard trolling motor 14 is disposed and maintained substantially parallel to the longitudinal centerline of the boat, thus allowing the maximum efficiency to be obtained from the outboard trolling motor 14.

Of course, it is understood that the mounting sleeve mechanisms 24 may comprise a plurality of deployment stop members 28 such that each of the outboard trolling motors 14 is disposable into any one of a plurality of predetermined deployed positions by simply rotating the positionable mounting member 22 outward and downward from the stowed position, along the substantially arcuate path of travel, until the positionable stop member 23 abuts the desired one of the plurality of deployment stop members 28. In particular, each of the plurality of predetermined deployed positions is at least partially defined by the outboard trolling motors 14 being disposed at one of a plurality of predetermined distances laterally outward from the side of the boat, once again, preferably off the stern of the boat, and submerged into the substantially undisturbed portion of the body of water at one of a plurality of predetermined depths below and substantially parallel to a normal surface of the body of water, while their corresponding thrust axes 17 are disposed and maintained substantially parallel to the longitudinal centerline of the boat.

Also, as illustrated in the preferred embodiment of FIG. 5, the mounting sleeve mechanism comprises a stowage stop member 29. Similar to the deployment stop members 28 described above, the stowage stop member 29 is structured such that the stowed position is at least partially defined by a portion of the positionable stop member 23 abutting a portion of the stowage stop member 29, such that further rotation of the positionable mounting member 22 in the direction of the abutting members is restricted. In one preferred embodiment, the stowed position is at least partially defined by the outboard trolling motors 14 being disposed out of the body of water and positioned above a portion of the hull of the boat, wherein the portion of the hull, in one preferred embodiment, is the transom. More in particular, each of the outboard trolling motors 14 is disposable into its stowed position by simply rotating the positionable mounting member 22, and the corresponding outboard trolling motor 14, inward and upward from its deployed position, along the substantially arcuate path of travel, until the positionable stop member 23 abuts the corresponding stowage stop member 29.

It is apparent from the foregoing that positioning of the outboard motor assembly 12 between the stowed position and one or more of the predetermined deployed positions, and vise versa, may be accomplished by manual movement of the positionable mounting member 23 and the corresponding outboard trolling motor 14. Of course, it is understood to be within the scope and intent of the present invention to employ one or more mechanical and/or motorized devices as are utilized to rotate a member, to assist and/or to effect the positioning of the outboard motor assembly 12 between the stowed position and the deployed position, and vise versa.

The outboard trolling motor deployment and control system 10 of the present invention further comprises a control assembly, generally as shown at 30. The control assembly 30 is disposed in a communicative relationship with the outboard motor assembly 12, and is structured to at least actuate the outboard trolling motor assembly 12. In one preferred embodiment, the control assembly 30 is further disposed in a communicative relationship with the outboard trolling motors 14. The system 10 of the present invention further comprises at least one power supply 19 disposed, at least temporarily, in an energizing relation with the outboard motor assembly 12. At least one embodiment of the present invention comprises a plurality of power supplies 19, each at least temporarily disposed in an energizing relation with a different one of a plurality of outboard motors 14. In one preferred embodiment, the at least one power supply 19 comprises a rechargeable marine battery, however, it is understood to be within the scope of the present invention for alternate forms of the power supply 19 to be utilized.

The control assembly 30 is further disposed in a communicative relationship with the at least one power supply 19 and is structured to actuate the outboard trolling motor assembly 12 by temporarily disposing the at least one power supply 19 into the energizing relation with the outboard trolling motor assembly 12. More specifically, the control assembly 30 comprises an actuation switch 32 structured to complete a circuit between the power supply 19 and the outboard trolling motor assembly 12, thereby actuating at least one of the outboard trolling motors 14. The actuation switch 32 may comprise any of a number of switching mechanisms commonly utilized in such control circuits.

In one other embodiment, the control assembly 30 comprises a plurality of actuation switches 32, each of the actuation switches 32 structured to actuate a corresponding one of the plurality of outboard trolling motors 14. In this embodiment, the system 10 may comprise a single power supply 19 disposed in the communicative relationship with the control assembly 30 and structured to at least temporarily energize each of the plurality of outboard trolling motors 14. Alternatively, this embodiment may comprise a plurality of power supplies 19, each disposed in a communicative relationship with the control assembly 30 and, further, each being structured to at least temporarily energize a different one of the plurality of outboard trolling motors 14.

In one preferred embodiment, the control assembly 30 further comprises a master actuation switch 33 structured to actuate the plurality of outboard trolling motors 14 substantially simultaneously. As in the embodiment comprising a plurality of actuation switches 32, this preferred embodiment may employ a single power supply 19 disposed in the communicative relationship with the control assembly 30 and structured to at least temporarily energize each of the plurality of outboard trolling motors 14 or, alternatively, it may comprise a plurality of power supplies 19 each disposed in the communicative relationship with the control assembly 30 and structured to energize a different one of each of the plurality of outboard trolling motors 14.

The control assembly 30 of the present invention may also include at least one direction switch 34. In particular, the direction switch 34 is structured to allow operation of the outboard trolling motor assembly 12 in either a forward direction or a reverse direction. In at least one embodiment, the control assembly comprises a plurality of direction switches 34, each structured to allow operation of a corresponding one of the at least one pair of outboard trolling motors 14 in either the forward direction or the reverse direction. This embodiment allows the operator to operate both of the pair of outboard trolling motors 14 in the same direction, so as propel the boat in either the forward direction or the reverse direction. Additionally, this embodiment permits the operator to operate the pair of outboard trolling motors 14 in opposite directions so as to turn and/or propel the boat in either a port direction or a starboard direction. As such, the control assembly 30 may be utilized to allow the operator to effectively steer the boat, without restricting the operator to the area immediately proximate the outboard trolling motors 14. In one preferred embodiment, the control assembly 10 of the present invention includes a master direction switch 35, the master direction switch 35 being structured to allow the operation of a plurality of outboard trolling motors 14 in either a forward direction or a reverse direction, substantially simultaneously.

In one further embodiment of the system 10 of the present invention, the control assembly 10 also comprises at least one speed switch 36, the speed switch 36 structured to operate the outboard trolling motor assembly 12 at any one of a plurality of motor speeds. At least one other embodiment includes a plurality of speed switches 36, each structured to operate a corresponding one of at least one pair of outboard trolling motors 14 at any one of the plurality of motor speeds. Once again, in one preferred embodiment, the control assembly 10 of the present invention comprises a master speed switch 37, the master speed switch 37 structured to operate at least the pair of outboard trolling motors 14 at any one of a plurality of motor speeds, substantially simultaneously.

As my be appreciated from the foregoing, the control assembly 10 of the present invention permits an operator to control the speed and direction of the boat from a location remote of the outboard trolling motor assembly 12, such that the operator is free to move about the boat to fish. Specifically, in one embodiment, the communicative relationship of the control assembly 30 with the outboard trolling motor assembly 12 may be established by way of physical connection, such as by a length of electrical or control wire between the control assembly 30 and the outboard trolling motor assembly 12, the wire being of sufficient length to permit the operator to move about essentially the entire deck of the boat. In one preferred embodiment, the communicative relationship may be established via a remote transmission from the control assembly 30 to a receiving unit proximate the outboard motor assembly 12, once again permitting the operator to move about essentially the entire deck of the boat, however, without the potential for entanglement with an electrical or control wire.

One further embodiment of the outboard trolling motor deployment and control system 10 of the present invention may also include a safety switch 39. In particular, the system 10 may comprise a safety switch 39 structured to prevent actuation of the outboard trolling motors 14 when they are not disposed in at least one of the predetermined deployed positions, so as to minimize the risk of injury to persons by the motors while stowed or while being stowed. The safety switch 39 of the present invention may include, but is not limited to, a simple gravity type switch, a contact switch, a differential pressure switch, etc.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An outboard trolling motor deployment and control system for a boat, said system comprising:

an outboard trolling motor assembly, a deployment assembly disposed in a cooperative engagement with said outboard trolling motor assembly, said deployment assembly further disposed in an interconnecting orientation with a hull of the boat, said deployment assembly structured to facilitate positioning said outboard trolling motor assembly along a substantially arcuate path of travel between a stowed position and at least one predetermined deployed position, said predetermined deployed position at least partially defined by said outboard trolling motor assembly disposed laterally outward from at least one side of the boat, said outboard trolling motor assembly comprising at least one thrust axis, said at least one thrust axis disposed and continuously maintained substantially parallel to a longitudinal centerline of the boat, and a control assembly disposed in a communicative relationship with said outboard trolling motor assembly, said control assembly structured to at least actuate said outboard trolling motor assembly.

2. A system as recited in claim 1 comprising at least one power supply disposed in an at least temporary energizing relation with said outboard trolling motor assembly.

3. A system as recited in claim 2 wherein said control assembly is disposed in a further communicative relationship with said at least one power supply and is structured to actuate said outboard trolling motor assembly by at least temporarily disposing said at least one power supply into said energizing relation with said outboard trolling motor assembly.

4. A system as recited in claim 1 wherein said predetermined deployed position is further defined by said outboard trolling motor assembly disposed laterally outward from at least one side of a stern of the boat.

5. A system as recited in claim 1 wherein said substantially arcuate path of travel is disposed in a generally vertical plane.

6. A system as recited in claim 1 wherein said outboard trolling motor assembly comprises at least one outboard trolling motor.

7. A system as recited in claim 1 wherein said outboard trolling motor assembly comprises at least one pair of outboard trolling motors.

8. A system as recited in claim 7 wherein each of said outboard trolling motors is structured to generate an amount of thrust along a corresponding thrust axis, each of said thrust axes disposed and continuously maintained substantially parallel to the longitudinal centerline of the boat.

9. A system as recited in claim 7 wherein said predetermined deployed position is further defined by each of said pair of outboard trolling motors disposed laterally outward from an opposite side of the boat.

10. A system as recited in claim 7 wherein said predetermined deployed position is further defined by each of said pair of outboard trolling motors disposed laterally outward a substantially equal distance from an opposite side of the boat.

11. A system as recited in claim 7 wherein said predetermined deployed position is further defined by each of said pair of outboard trolling motors disposed a substantially equal depth below a normal surface of the body of water.

12. A system as recited in claim 7 wherein each said outboard trolling motor comprises a propeller interconnected thereto by a drive shaft.

13. A system as recited in claim 7 wherein said deployment assembly comprises at least one pair of positionable mounting members, each of said positionable mounting members operatively engaging a different one of said outboard trolling motors.

14. A system as recited in claim 13 wherein said deployment assembly further comprises at least one pair of mounting sleeve mechanisms, each of said mounting sleeve mechanisms structured to interconnect a different one of said positionable mounting members to the boat through a portion of the hull.

15. A system as recited in claim 13 wherein said deployment assembly further comprises at least one pair of mounting sleeve mechanisms, each of said mounting sleeve mechanisms structured to movably interconnect a different one of said positionable mounting members to the boat through a portion of the hull.

16. A system as recited in claim 15 wherein each of said mounting sleeve mechanisms is further structured to rotatably interconnect a different one of said positionable mounting members to the boat through the portion of the hull.

17. A system as recited in claim 14 wherein each said mounting sleeve mechanism comprises a sealing mechanism, each of said sealing mechanisms structured to provide a liquid restrictive interconnection between a corresponding one of said positionable mounting members and the portion of the hull of the boat.

18. A system as recited in claim 17 wherein the portion of the hull is a transom.

19. A system as recited in claim 1 wherein said deployment assembly comprises at least one positionable mounting member wherein said predetermined deployed position is further defined by said thrust axis being disposed and continuously maintained in said substantially parallel disposition to the longitudinal centerline of the boat by said positionable mounting member.

20. An outboard trolling motor deployment and control system for a boat disposed in a body of water, said system comprising:

an outboard trolling motor assembly, said outboard trolling motor assembly comprising at least one pair of outboard trolling motors, a deployment assembly comprising at least one pair of positionable mounting members, each of said positionable mounting members operatively engaging a different one of said outboard trolling motors, each of said positionable mounting members further disposed in an interconnecting orientation with the boat via a corresponding mounting sleeve mechanism, said deployment assembly structured to facilitate positioning each of said outboard trolling motors along a substantially arcuate path of travel between a stowed position and at least one predetermined deployed position, said predetermined deployed position at least partially defined by each of said outboard trolling motors disposed laterally outward from an opposite side of a stern of the boat into a substantially undisturbed portion of the body of water, each of said outboard trolling motors structured to generate an amount of thrust along a corresponding thrust axis, each of said thrust axes disposed and continuously maintained substantially parallel to a longitudinal centerline of the boat, and a control assembly disposed in a communicative relationship with at least said outboard trolling motors.

21. A system as recited in claim 20 wherein said predetermined deployed position is further defined by each of said thrust axes submerged in the substantially undisturbed portion of the body of water and disposed substantially parallel to a normal surface of the body of water.

22. A system as recited in claim 20 wherein said deployment assembly is further structured to facilitate rotatably positioning each of said outboard trolling motors along said substantially arcuate path of travel between said stowed position and said predetermined deployed position.

23. A system as recited in claim 20 wherein each of said positionable mounting members comprise a positionable stop member structured to facilitate disposing a corresponding one of said outboard trolling motors between said stowed position and said at least one predetermined deployed position.

24. A system as recited in claim 23 wherein each of said mounting sleeve mechanisms comprise at least one deployment stop member.

25. A system as recited in claim 24 wherein said predetermined deployed position is at least partially defined by a portion of one of said positionable stop members abutting a portion of a corresponding one of said at least one deployment stop member.

26. A system as recited in claim 23 wherein each of said mounting sleeve mechanisms comprise a plurality of deployment stop members.

27. A system as recited in claim 26 wherein said deployment assembly is further structured to facilitate positioning each of said outboard trolling motors along a substantially arcuate path of travel between a stowed position and each of a plurality of predetermined deployed positions.

28. A system as recited in claim 27 wherein each of said plurality of predetermined deployed positions is at least partially defined by a portion of one of said positionable stop members abutting a portion of a corresponding one of said plurality of deployment stop members.

29. A system as recited in claim 23 wherein each of said mounting sleeve mechanisms comprise at least one stowage stop member.

30. A system as recited in claim 29 wherein said stowed position is at least partially defined by a portion of one of said positionable stop members abutting a portion of a corresponding one of said at least one stowage stop member.

31. A system as recited in claim 20 wherein said stowed position is at least partially defined by said outboard trolling motors disposed out of the body of water and positioned above a portion of the hull of the boat.

32. A system as recited in claim 31 wherein the portion of the hull is a transom.

33. An outboard trolling motor deployment and control system for a boat disposed in a body of water, said system comprising:

an outboard trolling motor assembly comprising at least one pair of outboard trolling motors, a deployment assembly comprising at least one pair of positionable mounting members, each of said positionable mounting members operatively engaging a different one of said outboard trolling motors, said deployment assembly further disposed in an interconnecting orientation with the boat, said deployment assembly structured to facilitate positioning each of said outboard trolling motors along a substantially arcuate path of travel between a stowed position and at least one predetermined deployed position, said predetermined deployed position at least partially defined by each of said outboard trolling motors disposed laterally outward from an opposite side of the stern of the boat in a substantially undisturbed portion of the body of water, each of said outboard trolling motors structured to generate an amount of thrust along a corresponding thrust axis, each of said thrust axes disposed and continuously maintained substantially parallel to a longitudinal centerline of the boat, a control assembly disposed in a communicative relationship with at least said outboard trolling motors, at least one power supply at least temporarily disposed in an energizing relation with said outboard trolling motors, and said control assembly structured to at least actuate said outboard trolling motors.

34. A system as recited in claim 33 wherein said control assembly comprises at least one actuation switch, said actuation switch structured to actuate at least one of said outboard trolling motors.

35. A system as recited in claim 33 wherein said control assembly comprises a plurality of actuation switches, each of said actuation switches structured to actuate a corresponding one of said outboard trolling motors.

36. A system as recited in claims 33 wherein said control assembly comprises a master actuation switch, said master actuation switch structured to actuate at least said pair of outboard trolling motors.

37. A system as recited in claim 33 wherein said control assembly comprises at least one direction switch, said direction switch structured to operate at least one of said outboard trolling motors in either a forward direction or a reverse direction.

38. A system as recited in claim 33 wherein said control assembly comprises a plurality of direction switches, each of said direction switches structured to operate a corresponding one of said outboard trolling motors in either a forward direction or a reverse direction.

39. A system as recited in claims 33 wherein said control assembly comprises a master direction switch, said master direction switch structured to operate at least said pair of outboard trolling motors in either a forward direction or a reverse direction.

40. A system as recited in claim 33 wherein said control assembly comprises at least one speed switch, said speed switch structured to operate at least one of said outboard trolling motors at any one of a plurality of motor speeds.

41. A system as recited in claim 33 wherein said control assembly comprises a plurality of speed switches, each of said speed switches structured to operate a corresponding one of said outboard trolling motors at any one of a plurality of motor speeds.

42. A system as recited in claim 33 wherein said control assembly comprises a master speed switch, said master speed switch structured to operate at least said pair of outboard trolling motors at any one of a plurality of motor speeds.

43. A system as recited in claim 33 further comprising a safety switch, said safety switch structured to prevent said actuation of said outboard trolling motors when said motors are not disposed in said predetermined deployed position.

44. An outboard trolling motor deployment and control system for a boat disposed in a body of water, said system comprising:

an outboard trolling motor assembly comprising at least one pair of outboard trolling motors, each of said outboard trolling motors structured to generate an amount of thrust along a corresponding thrust axis, each of said thrust axes disposed and continuously maintained substantially parallel to a longitudinal centerline of the boat, a deployment assembly comprising at least one pair of positionable mounting members each operatively engaging a different one of said outboard trolling motors, said deployment assembly further disposed in an interconnecting orientation with a transom of the boat, said deployment assembly structured to facilitate rotatably positioning each of said outboard trolling motors along a substantially arcuate path of travel between a stowed position and at least one predetermined deployed position, said deployment assembly further structured to maintain each of said thrust axes disposed substantially parallel with the longitudinal centerline of the boat at each point along said substantially arcuate path of travel, said predetermined deployed position at least partially defined by each of said outboard trolling motors disposed laterally outward a substantially equal distance from an opposite side of the stern of the boat in a substantially undisturbed portion of the body of water, said predetermined deployed position further defined by each of said outboard trolling motors disposed a substantially equal depth below a normal surface of the substantially undisturbed portion of the body of water, a control assembly disposed in a communicative relationship with at least said outboard trolling motors, at least one power supply at least temporarily disposed in an energizing relation with said outboard trolling motors, and said control assembly structured to at least actuate said outboard trolling motors.

45. An outboard trolling motor deployment and control system for a boat disposed in a body of water, said system comprising:

an outboard trolling motor assembly comprising at least one pair of outboard trolling motors, a deployment assembly comprising at least one pair of positionable mounting members, each of said positionable mounting members structured to be disposed in an interconnecting orientation with a portion of the boat and structured to operatively engage a different one of said outboard trolling motors, each of said positionable mounting members further structured and disposed to facilitate positioning a corresponding one of said outboard trolling motors along a substantially arcuate path of travel between a stowed position and at least one predetermined deployed position, said predetermined deployed position at least partially defined by each of said outboard trolling motors disposed laterally outward from an opposite side of the stern of the boat in a substantially undisturbed portion of the body of water, each of said outboard trolling motors structured to generate an amount of thrust along a corresponding thrust axis, and said predetermined deployed position is further defined by each of said thrust axes being disposed and continuously maintained in said substantially parallel disposition to the longitudinal centerline of the boat by a corresponding one of said positionable mounting members.

46. An outboard trolling motor deployment and control system for a boat disposed in a body of water, said system comprising:

an outboard trolling motor assembly comprising at least one pair of outboard trolling motors, a deployment assembly comprising at least one pair of positionable mounting members, each of said positionable mounting members operatively engaging a different one of said outboard trolling motors, each of said positionable mounting members further disposed in an interconnecting orientation with a transom of the boat via a corresponding mounting sleeve mechanism, said deployment assembly structured to facilitate positioning each of said outboard trolling motors along a substantially arcuate path of travel between a stowed position and at least one predetermined deployed position, said predetermined deployed position at least partially defined by each of said outboard trolling motors disposed laterally outward from an opposite side of a stern of the boat in a substantially undisturbed portion of the body of water, each of said outboard trolling motors structured to generate an amount of thrust along a corresponding thrust axis, each of said thrust axes disposed and continuously maintained substantially parallel to a longitudinal centerline of the boat, a control assembly disposed in a communicative relationship with at least said outboard trolling motors, at least one power supply at least temporarily disposed in an energizing relation with said outboard trolling motors, and said control assembly structured to at least actuate said outboard trolling motors.

* * * * *